US011744423B2

(12) United States Patent
Ma

(10) Patent No.: US 11,744,423 B2
(45) Date of Patent: Sep. 5, 2023

(54) TELESCOPIC CONDUCTIVE TUBE

(71) Applicant: Shenzhen Shermon Technology Co., Limited, Shenzhen (CN)

(72) Inventor: Chaoliang Ma, Shenzhen (CN)

(73) Assignee: SHENZHEN SHERMON TECHNOLOGY CO., LIMITED, Shenzhen (CN)

( * ) Notice: Subject to any disclaimer, the term of this patent is extended or adjusted under 35 U.S.C. 154(b) by 329 days.

(21) Appl. No.: 17/241,062

(22) Filed: Apr. 27, 2021

(65) Prior Publication Data

US 2022/0338693 A1 Oct. 27, 2022

(51) Int. Cl.
*A47L 9/24* (2006.01)

(52) U.S. Cl.
CPC ..... *A47L 9/246* (2013.01); *A47L 9/244* (2013.01); *A47L 9/248* (2013.01)

(58) Field of Classification Search
CPC ... A47L 9/02; A47L 9/24; A47L 9/242; A47L 9/246; A47L 9/248; A47L 5/225
USPC ..... 15/414; 174/68.1, 70 C, 71 R, 72 R, 174/88 R, 95, 380; 285/7
See application file for complete search history.

(56) References Cited

U.S. PATENT DOCUMENTS 9,155,438 B2 * 10/2015 Park ..... A47L 9/246
2014/0042739 A1 * 2/2014 Zeng ..... A47L 9/244 285/145.1
2019/0208974 A1 * 7/2019 Oka ..... A47L 9/1666

FOREIGN PATENT DOCUMENTS

WO WO-2012074207 A2 * 6/2012 ..... A47L 9/244

OTHER PUBLICATIONS

W02012074207—Machine Translation (Year: 2012).*

* cited by examiner

*Primary Examiner* — Orlando E Aviles
*Assistant Examiner* — Alberto Saenz

(57) ABSTRACT

A telescopic conductive tube is provided, including a conductive assembly. The conductive assembly includes an isolating guide, an isolating restraining tube, a rail, a wire, a guiding rod and a conductive spring. The conductive spring is sleeved on the guiding rod and electrically connects with the wire. The guiding rod and the conductive spring are accommodated within the isolating restraining tube. The isolating restraining tube is accommodated within the isolating guide. The wire is accommodated within the rail. The isolating restraining tube has one end inserted into the rail. The rail is slidable relative to the isolating guide. When sliding into the isolating guide, the rail slides along an outer wall of the isolating restraining tube, and the conductive spring is compressed by a bottom of the rail.

10 Claims, 5 Drawing Sheets

TELESCOPIC CONDUCTIVE TUBE

TECHNICAL FIELD

The disclosure relates to accessories for vacuum cleaners, and in particular to a telescopic conductive tube.

BACKGROUND

As is well known, a hand-held vacuum cleaner generally includes a main body, a suction head, and a suction tube connecting the suction head with the main body. The suction tube is provided with a conductive assembly therein which directs electric power to the suction head with control of the main body so that the suction head starts to operate. However, the current suction tube has a fixed length larger than lengths and/or widths of the main body and the section head, which renders the vacuum cleaner inconvenient to be carried, unpopular among the consumers, and inconvenient to be packaged for sale. In order to overcome the above-mentioned defects, in some of the vacuum cleaners, the suction tube has been improved to be telescopic. However, the telescopic suction tube in the existing technology has several defects. For example, the conductive assembly has considerably complicated designs and structures since the conductive assembly should be extend or furl with lengthening or shortening of the suction tube, and maintenance of the conductive assembly is inconvenient in case of use accident, Chinese Patent Application No. 201610063853.9 discloses a telescopic conductive tube and a hand-held vacuum cleaner. In the telescopic conductive tube, a conductive joint has two sides both provided with elastic pieces and is electrically connected with contact strips through the elastic pieces. The elastic pieces are relatively thin and easy to lose elasticity and thus to be further bent or broken after a period of use, thereby affecting the electrical connection with the contact strips and resulting a relative short service life of the telescopic conductive tube. Therefore, it is necessary to maintain the electrical connection of the conductive assembly during lengthening or shortening of the suction tube, so as to increase the service life of the telescopic conductive tube.

SUMMARY

In order to solve the above-mentioned problem, the present disclosure provides a telescopic conductive tube.

The present disclosure is realized by the following technical solutions.

The present disclosure provides a telescopic conductive tube, including a conductive assembly, where the conductive assembly includes an isolating guide, an isolating restraining tube, a rail, a wire, a guiding rod and a conductive spring, the conductive spring is sleeved on the guiding rod and electrically connects with the wire, the guiding rod and the conductive spring are accommodated within the isolating restraining tube, the isolating restraining tube is accommodated within the isolating guide, the wire is accommodated within the rail, the isolating restraining tube has an end inserted into the rail, and the rail is slidable relative to the isolating guide. When sliding into the isolating guide, the rail slides along an outer wall of the isolating restraining tube, and the conductive spring is compressed by a bottom of the rail.

In some embodiments, the isolating guide defines a sliding slot therein, the rail is provided with a stopper at the bottom thereof. When the rail slides within the sliding slot, the guiding rod passes through the stopper, the conductive spring is compressed by the stopper, and the isolating restraining tube is inserted into the rail through two sides of the stopper.

In some embodiments, the conductive assembly further includes an electrode pin and a first electrical terminal, the electrode pin has an end electrically connecting with the wire, and an other end inserted into the first electrical terminal and fixed thereto, and the first electrical terminal has an end portion fixed to a head portion of the rail.

In some embodiments, the conductive assembly further comprises a second electrical terminal fixed to the isolating guide, and the conductive spring extends out of the isolating restraining tube to be inserted into the second electrical terminal and fixed thereto.

In some embodiments, the telescopic conductive tube further includes a telescopic assembly provided with a first tube body and a second tube body telescoping relative to each other, and the conductive assembly is mounted along outer surfaces of the first tube body and the second tube body.

In some embodiments, the telescopic assembly further includes a first fastening head and a locking member fixed to the second tube body, the first tube body has an end fixed to the first fastening head, and an other end passing through the locking member to be inserted into the second tube body.

In some embodiments, the telescopic assembly further includes a locking strip, a positioning slot is defined on the first tube body and in which the locking strip is mounted, and the locking strip has an end inserted into the first fastening head and fixed thereto.

In some embodiments, the locking member is provided with a button configured to engage with the locking strip.

In some embodiments, the second tube body is provided thereon with a mounting tube in which the isolating guide is accommodated and fixed, and the first fastening head is provided with a first fixing groove in which the first fastening head is inserted and fixed.

In some embodiments, the telescopic assembly further comprises a second fastening head provided thereon with a second fixing groove, the second fastening head is fixed to an end of the second tube body, and the second electrical terminal is inserted into the second fixing groove and fixed thereto.

The present application has the following advantages.

In the telescopic conductive tube of the present disclosure, the conductive assembly is improved by using a conductive spring. When the telescopic conductive tube is lengthened or shortened, the conductive spring may enable a stable electrical connection of the conductive assembly without poor contact, and meanwhile the conductive spring is not easy to be damaged, such that the service life of the telescopic conductive tube is increased. Due to the stopper provided at the bottom of the rail, a limited limitation to the length of the conductive spring can be ensured when the conductive assembly is lengthened or shortened with the lengthening or shortening of the telescopic assembly, such that the telescopic conductive tube may work normally in the lengthening or shortening function.

DETAILED DESCRIPTION

The present disclosure will be further described below with reference to the accompanying drawings for more clearly and fully discussing the technical solutions of the present disclosure.

Figure 1:
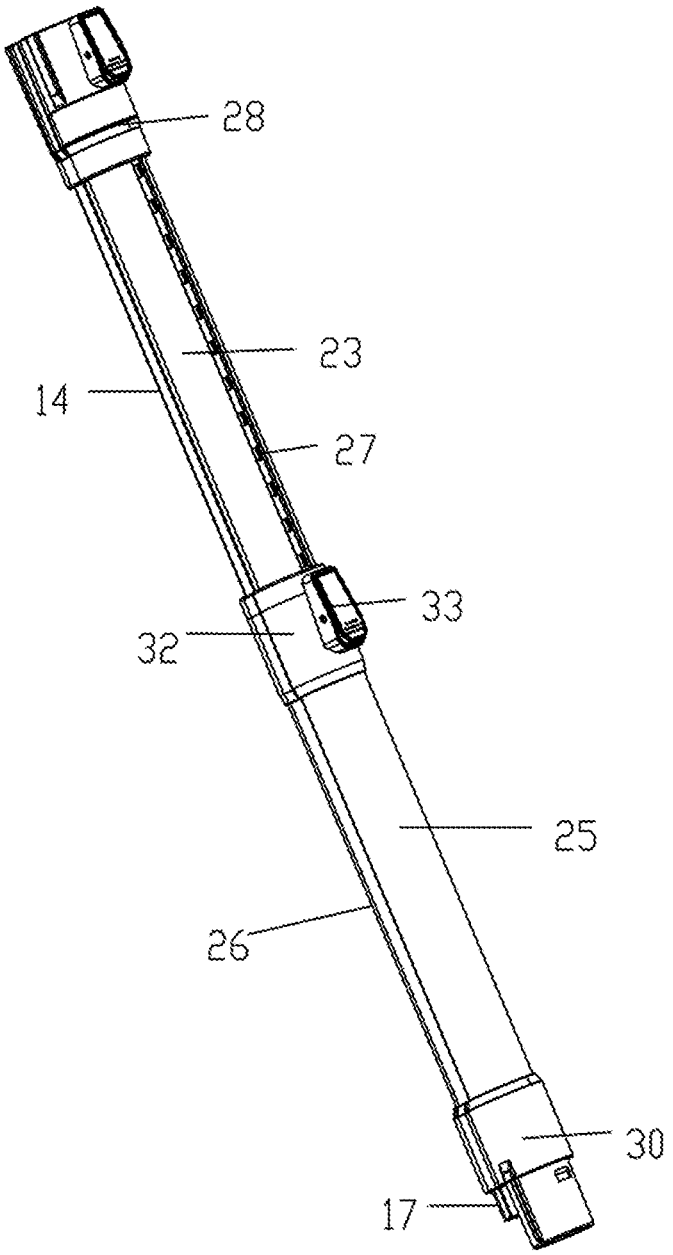
FIG. 1 is a schematical structural view of a telescopic conductive tube according to the present disclosure.
Figure 2:
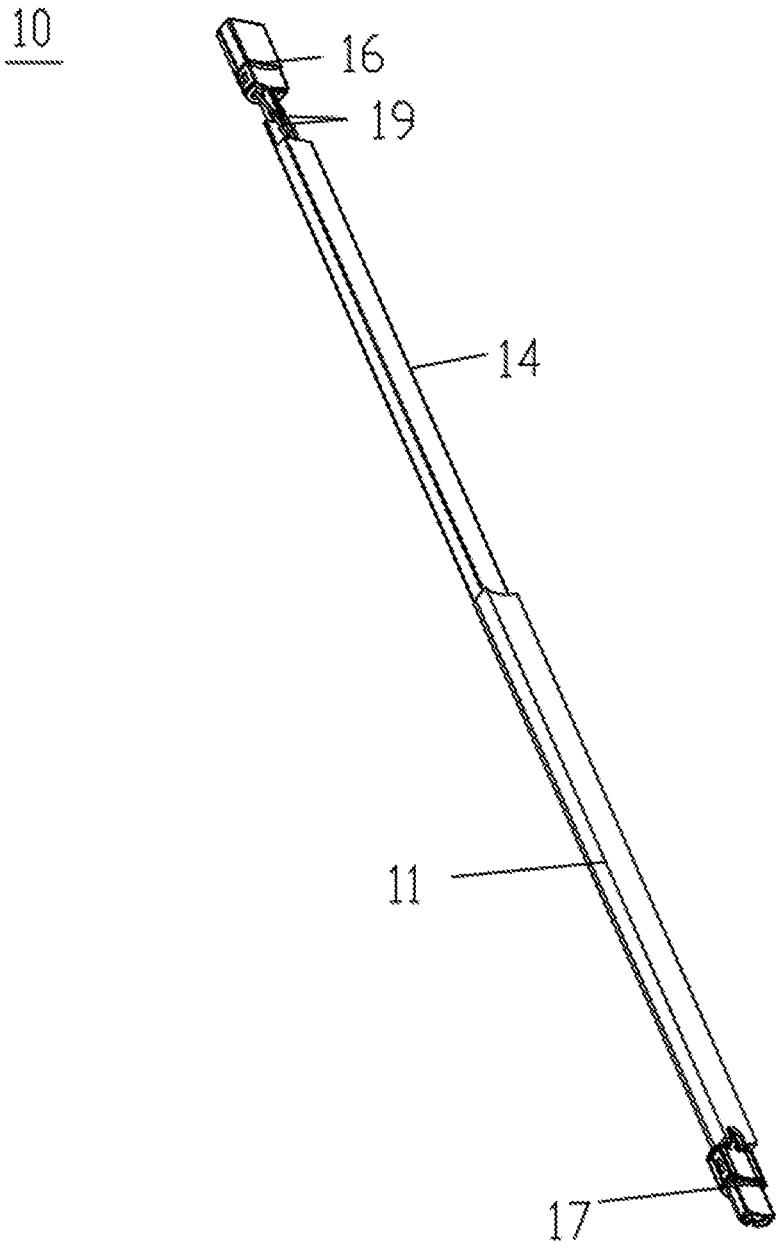
FIG. 2 is a schematical structural view of a conductive assembly according to the present disclosure.
Figure 3:
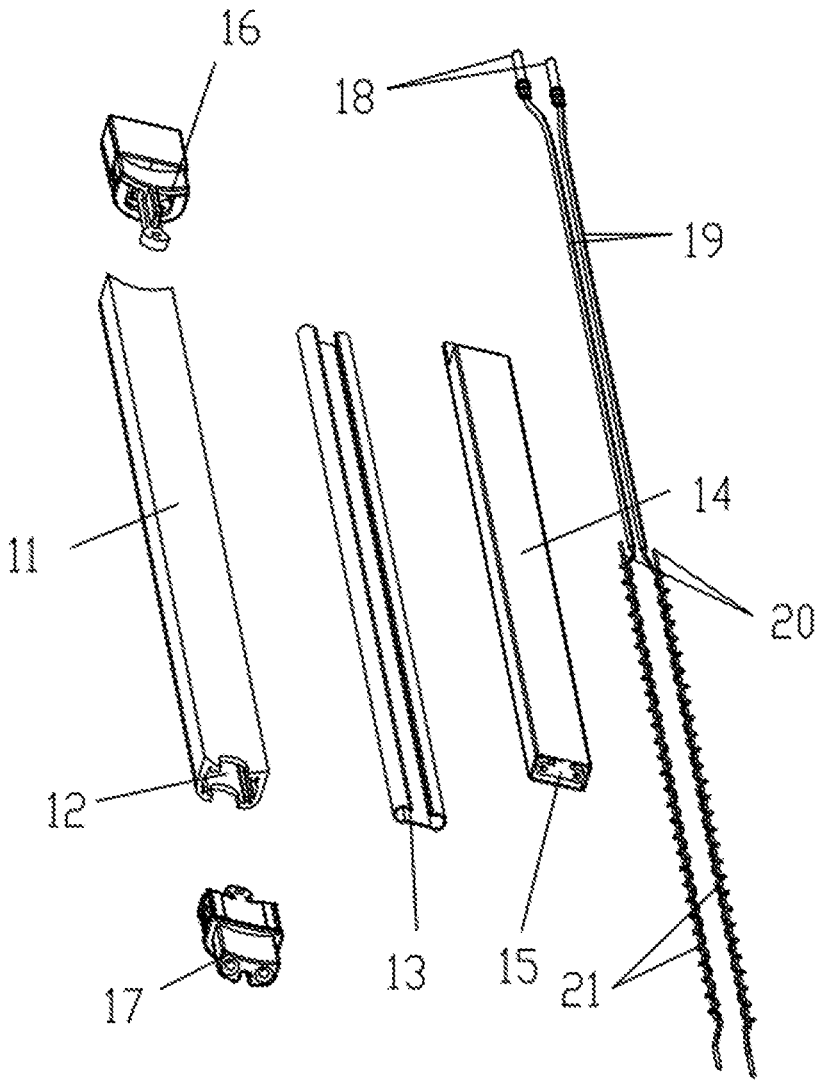
FIG. 3 is an exploded view of the conductive assembly according to the present disclosure.
Figure 4:
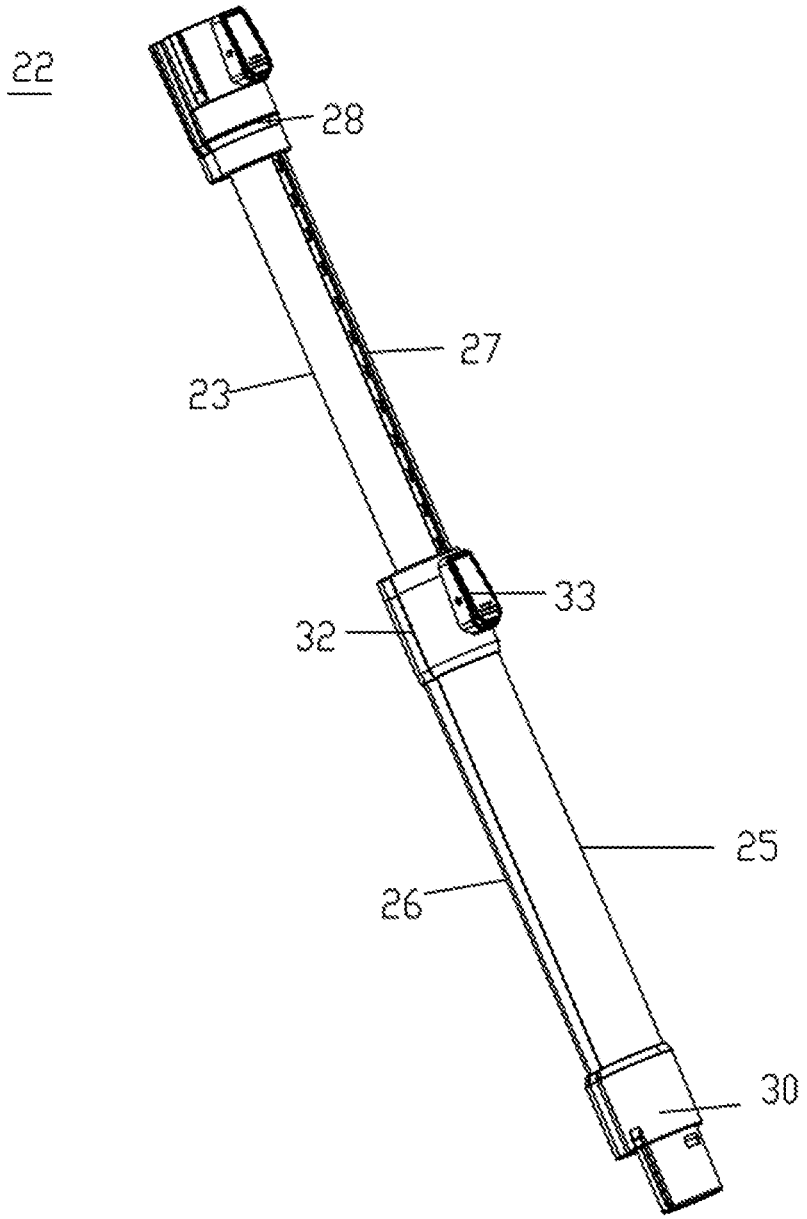
FIG. 4 is a schematical structural view of a telescopic assembly according to the present disclosure.
Figure 5:
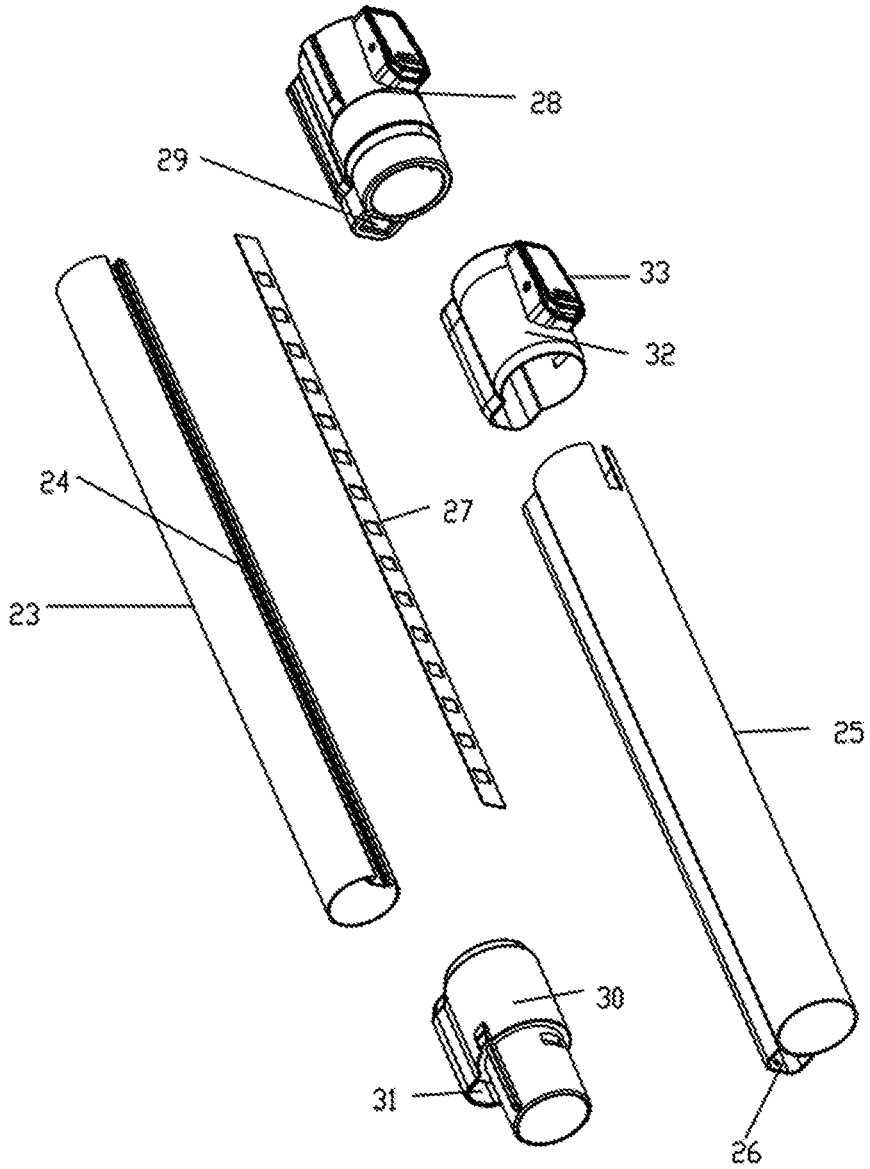
FIG. 5 is an exploded view of the telescopic assembly according to the present disclosure.

As shown in FIGS. 1 to 5, the present disclosure provides a telescopic conductive tube including a conductive assembly 10. The conductive assembly 10 includes an isolating guide 11, an isolating restraining tube 13, a rail 14, a wire 19, a guiding rod 20 and a conductive spring 21. The conductive spring is sleeved on the guiding rod 20 and electrically connects with the wire 19. The guiding rod 20 and the conductive spring 21 are accommodated within the isolating restraining tube 13. The isolating restraining tube 13 is accommodated within the isolating guide 11. The wire 19 is accommodated within the rail 14. The isolating restraining tube 13 has an end inserted into the rail 14. The rail 14 is slidable relative to the isolating guide 11. When sliding into the isolating guide 11, the rail 14 slides along an outer wall of the isolating restraining tube 13, and the conductive spring 21 is compressed by a bottom of the rail 14. The isolating guide 11 defines a sliding slot 12 therein. The rail 14 is provided with a stopper 15 at the bottom thereof. When the rail 14 slides within the sliding slot 12, the guiding rod 20 passes through the stopper 15, the conductive spring 21 is compressed by the stopper 15, and the isolating restraining tube 13 is inserted into the rail 14 through two sides of the stopper 15. The conductive assembly 10 further includes an electrode pin 18 and a first electrical terminal 16. The electrode pin 18 has an end electrically connecting with the wire 19, and an other end inserted into the first electrical terminal 16 and fixed thereto. The first electrical terminal 16 has an end portion fixed to a head portion of the rail 14. The conductive assembly 10 further includes a second electrical terminal 17 fixed to the isolating guide 11. The conductive spring 21 extends out of the isolating restraining tube 13 to be inserted into the second electrical terminal 17 and fixed thereto. The conductive spring 21 may be made from copper or copper alloy.

In this embodiment, the stopper 15 is disposed at the bottom of the rail 14, and a gap is defined between each of the two sides of the stopper 15 and a side wall of the rail 14. The isolating restraining tube 13 may be inserted into the rail 14 through the gaps. Two conductive springs 21, two guiding rods 20 and two wires 19 are provided. Two through holes are defined on the stopper 15 for allowing the guiding rods 15 to pass through. When the conductive assembly 15 is shortened, the rail 14 moves into the sliding slot 12, the isolating restraining tube 13 is inserted into the rail 14, the stopper 15 moves downward to compress the conductive springs 21, and the guiding rods 20 are inserted into the rail 14 via the through holes of the stopper 15. The first electrical terminal 16 and the second electrical terminal 17 are both provided with sockets for electrically connects the telescopic conductive tube to a power supply and a vacuum cleaner.

Further, the telescopic conductive tube further includes a telescopic assembly 22 provided with a first tube body 23 and a second tube body 25 telescoping relative to each other. The conductive assembly 10 is mounted along outer surfaces of the first tube body 23 and the second tube body 25. The telescopic assembly 22 further includes a first fastening head 28 and a locking member 32 fixed to the second tube body 25. The first tube body 23 has an end fixed to the first fastening head 28, and an other end passing through the locking member 32 to be inserted into the second tube body 25.

In this embodiment, the first tube body 23 and the second tube body 25 are both made from aluminum or aluminum alloy. The second tube body 25 has a diameter larger than that of the first tube body 23. When the telescopic assembly 22 is shortened, the first tube body 23 is retracted into the second tube body 25.

Further, the telescopic assembly 22 further includes a locking strip 27. A positioning slot 24 is defined on the first tube body 23 and in which the locking strip 27 is mounted. The locking strip 27 has an end inserted into the first fastening head 28 and fixed thereto. The locking member 32 is provided with a button 33 configured to engage with the locking strip 27.

In this embodiment, a plurality of apertures are defined on the locking strip 27 and arranged in a row. The button 33 engages with the locking strip 27 via the plurality of apertures to prevent the telescopic conductive tube from being lengthened or shortened.

Further, the second tube body 25 is provided thereon with a mounting tube 26 in which the isolating guide 11 is accommodated and fixed. The first fastening head is provided with a first fixing groove 29 in which the first fastening head 16 is inserted and fixed. The telescopic assembly 22 further includes a second fastening head 30 provided thereon with a second fixing groove 31. The second fastening head 30 is fixed to an end of the second tube body 25, and the second electrical terminal 17 is inserted into the second fixing groove 31 and fixed thereto.

It should be noted that the present disclosure may have other various embodiments. Modifications and variations made by those skilled in the art based on the embodiments according to the present disclosure without any creative work also fall within the scope of the present disclosure.

What is claimed is:

1. A telescopic conductive tube, comprising a conductive assembly, wherein the conductive assembly comprises an isolating guide, an isolating restraining tube, a rail, a wire, a guiding rod and a conductive spring, the conductive spring is sleeved on the guiding rod and electrically connects with the wire, the guiding rod and the conductive spring are accommodated within the isolating restraining tube, the isolating restraining tube is accommodated within the isolating guide, the wire is accommodated within the rail, the isolating restraining tube has an end inserted into the rail, the rail is slidable relative to the isolating guide, and wherein when sliding into the isolating guide, the rail slides along an outer wall of the isolating restraining tube, and the conductive spring is compressed by a bottom of the rail.

2. The telescopic conductive tube according to claim 1, wherein the isolating guide defines a sliding slot therein, the rail is provided with a stopper at the bottom thereof, when the rail slides within the sliding slot, the guiding rod passes through the stopper, the conductive spring is compressed by the stopper, and the isolating restraining tube is inserted into the rail through two sides of the stopper.

3. The telescopic conductive tube according to claim 2, wherein the conductive assembly further comprises an electrode pin and a first electrical terminal, the electrode pin has an end electrically connecting with the wire, and an other end inserted into the first electrical terminal and fixed thereto, and the first electrical terminal has an end portion fixed to a head portion of the rail.

4. The telescopic conductive tube according to claim 3, wherein the conductive assembly further comprises a second electrical terminal fixed to the isolating guide, and the conductive spring extends out of the isolating restraining tube to be inserted into the second electrical terminal and fixed thereto.

5. The telescopic conductive tube according to claim 4, further comprising a telescopic assembly provided with a first tube body and a second tube body telescoping relative to each other, wherein the conductive assembly is mounted along outer surfaces of the first tube body and the second tube body.

6. The telescopic conductive tube according to claim 5, wherein the telescopic assembly further comprises a first fastening head and a locking member fixed to the second tube body, the first tube body has an end fixed to the first fastening head, and an other end passing through the locking member to be inserted into the second tube body.

7. The telescopic conductive tube according to claim 6, wherein telescopic assembly further comprises a locking strip, a positioning slot is defined on the first tube body and in which the locking strip is mounted, and the locking strip has an end inserted into the first fastening head and fixed thereto.

8. The telescopic conductive tube according to claim 7, wherein the locking member is provided with a button configured to engage with the locking strip.

9. The telescopic conductive tube according to claim 7, wherein the second tube body is provided thereon with a mounting tube in which the isolating guide is accommodated and fixed, and the first fastening head is provided with a first fixing groove in which the first fastening head is inserted and fixed.

10. The telescopic conductive tube according to claim 9, wherein the telescopic assembly further comprises a second fastening head provided thereon with a second fixing groove, the second fastening head is fixed to an end of the second tube body, and the second electrical terminal is inserted into the second fixing groove and fixed thereto.

* * * * *